United States Patent [19]

Poggio et al.

[11] 4,145,018

[45] Mar. 20, 1979

[54] PROTECTIVE DEVICE FOR RAILROAD SIGNALING APPARATUS

[75] Inventors: Mario Poggio; Federico Muratore, both of Turin, Italy

[73] Assignee: WABCO Westinghouse, Turin, Italy

[21] Appl. No.: 880,398

[22] Filed: Feb. 23, 1978

[30] Foreign Application Priority Data

Mar. 18, 1977 [IT] Italy ..... 67601 A/77

[51] Int. Cl.[2] ..... B61L 21/06

[52] U.S. Cl. ..... 246/34 R; 246/34 D; 246/35; 246/43

[58] Field of Search ..... 246/34 R, 34 D, 35, 246/36, 37, 42, 43, 28 K; 324/217

[56] References Cited

U.S. PATENT DOCUMENTS

| | | | |
|---|---|---|---|
| 3,267,280 | 8/1966 | Buck | 246/34 R |
| 3,287,554 | 11/1966 | Staples | 246/35 |
| 4,022,408 | 5/1977 | Staples | 246/34 R |

*Primary Examiner*—Trygve M. Blix
*Assistant Examiner*—Reinhard J. Eisenzopf
*Attorney, Agent, or Firm*—A. G. Williamson, Jr.; R. W. McIntire, Jr.

[57] ABSTRACT

The receiver of an audio frequency (AF) track circuit for a track section of an electric propulsion railroad is coupled across an associated impedance bond by the primary and secondary windings of a saturable transformer. The control winding of this transformer receives energy signals from a voltage comparator network which compares input signals from two pick up coils, one positioned in inductive relationship with each rail at the receiver end of the section. These coils are tuned to respond to a selected ripple characteristic of the rectified DC propulsion energy, e.g., the sixth harmonic of the basic AC power supply source. When the propulsion currents, and particularly the selected ripple characteristic, in the two rails are unequal, due to a broken rail, intervening ground, or other fault condition, unequal input signals from the coils actuate an output from the comparator which energizes the control winding, thus saturating the transformer core to uncouple the primary and secondary windings to interrupt the coupling between impedance bond and track receiver to register and hold a section occupancy indication, a fail-safe condition.

10 Claims, 2 Drawing Figures

PROTECTIVE DEVICE FOR RAILROAD SIGNALING APPARATUS

BACKGROUND OF THE INVENTION

My invention pertains to fault protection arrangements for railroad track circuits. More specifically, the invention relates to apparatus providing protection against improper operation of track circuit apparatus in electrified railroads if the propulsion return current becomes unbalanced in the rails due to any one of several possible fault conditions.

On electrified railroads, there is always a possibility that unbalanced propulsion return currents in the rails may affect the operation of track circuits and cause an unsafe condition to occur in the signaling system. This is especially true where direct current (DC) propulsion power is supplied by rectifying an alternating current (AC) power source and AC track circuits within the audio frequency (AF) range are used. It is normal for such rectified DC power to include ripple characteristics at various harmonics of the basic AC supply. Such harmonics may be in the same frequency range as the AF track circuits. The unbalance of the propulsion currents in the rails is normally due to a fault condition. Such faults include a broken section in one track rail, excessive leakage to ground from one rail, or a broken down insulated rail joint. The fault may also occur within the rectifier apparatus supplying the DC propulsion power. In the well-known six phase rectification using solid-state or mercury arc rectifier elements, the failure of one leg of the rectifier network may create a high level of harmonic ripple in one rail. The so-called chopper type electric locomotives under some conditions may create an unbalance of the harmonic ripple components of the return currents. Such unbalanced currents and harmonic components may feed into the AC (AF) track circuit receiver means, through the impedance bonds, to cause improper operation, particularly if the harmonic frequency is close to that of the track circuit. The incorrect energization of the track receiver will cause the registration of an unoccupied section even though a train is present in the section, an obviously unsafe and dangerous situation.

Accordingly, an object of my invention is an improved fault protection arrangement for railroad track circuits on electrified railroads.

Another object of the invention is apparatus for protecting an AC track circuit against improper operation due to unbalanced propulsion currents in the rails of an electrified railroad.

A further object of my invention is fault protection apparatus associated with a track section in an electrified railroad which is responsive to an unbalanced condition of the propulsion return currents in the rails to inhibit the operation of the corresponding signal control track circuit to avoid improper operation of the railroad signaling system.

Yet another object of the invention is a fault protected track circuit arrangement responsive to the detection of an unbalanced condition of the propulsion return current in the rails to inhibit operation of the track circuit to prevent improper and unsafe signal conditions.

A still further object of my invention is apparatus for inhibiting operation of a track circuit to register an unoccupied track section if a fault condition exists, which includes means for detecting the level of a selected characteristic of the propulsion current in each rail and a comparator circuit network responsive to an unbalanced condition of the selected characteristic to interrupt operation of the track circuit to prevent an unsafe signal condition for that section.

Other objects, features, and advantages of the invention will be apparent from the following specification and appended claims, when taken with the accompanying drawings.

SUMMARY OF THE INVENTION

The arrangement of my invention is for use in each track section in an electrified railroad where propulsion power is picked up from a catenary (trolley) wire or third rail and returned through the rails. For signaling purposes, each track section is also provided with an AC track circuit which embodies the invention apparatus and includes transmitter and receiver elements, one at each end of the section. Each track circuit transmitter and receiver is coupled to the rails by a center tapped winding of an impedance bond connected across the section rails at the corresponding end to provide a return circuit path for the propulsion current through the rails and the center tap, either to a ground connection or the tap on the adjacent section bond. The total propulsion current normally divides substantially equally between the two rails, so that induced voltages in each half of the impedance bond winding are opposing and thus cancel any effect on the receiver.

To provide fault protection to the track circuit, so that unbalanced propulsion currents do not improperly energize the track circuit receiver, the invention first inserts a coupling transformer of the saturable type between the impedance bond and the receiver element. The primary and secondary windings provide the actual coupling, which is normally effective. This saturable transformer's control winding or windings are controlled by receiver devices responsive to the propulsion current flowing in each rail. When no signal is applied to the control winding, the transformer passes current signals from the rails to the receiver and the track circuit is operable to detect the presence or absence of trains in the section, i.e., register the section occupied or unoccupied, respectively, to control a signalling system. When control signals are applied to the control winding, the transformer core becomes saturated to inhibit the transmission of track circuit signals from the rails or bond to the receiver. This interrupts normal operation of the track circuit and registers an occupied section, which is a fail-safe condition.

The basic source of the control signals for energizing the control winding is a pair of receiver or pick up coils positioned to be inductively coupled to the rails in the vicinity of the receiver end bond connections to the rails. For example, one coil may be mounted on the bottom of each rail. Each coil is tuned to respond to a selected characteristic of the propulsion current in the rails, e.g., a ripple frequency of the rectified DC propulsion current at a selected harmonic of the commercial frequency AC power source. The output voltage signal of each coil is applied to a comparator circuit network which produces an output only if the two applied input signals differ by a predetermined amount. The comparator is connected to supply its output to the control winding(s) of the coupling transformer. Thus, if the propulsion current is detected as being unbalanced between the rails, presumable because of some fault condition, the transmission of signals from the impedance bond to the track receiver is inhibited by the saturation of the transformer core. This prevents any unbalance of the propulsion current characteristic in the two portions of the bond winding from improperly energizing the track receiver.

BRIEF DESCRIPTION OF THE DRAWINGS

I shall now describe in greater detail an arrangement of track circuit protection apparatus embodying my invention as illustrated in the accompanying drawings, in which.

In each of the drawing figures, the same or similar apparatus is designated by similar reference characters.

DETAILED DESCRIPTION OF THE ILLUSTRATED EMBODIMENT

Figure 1:
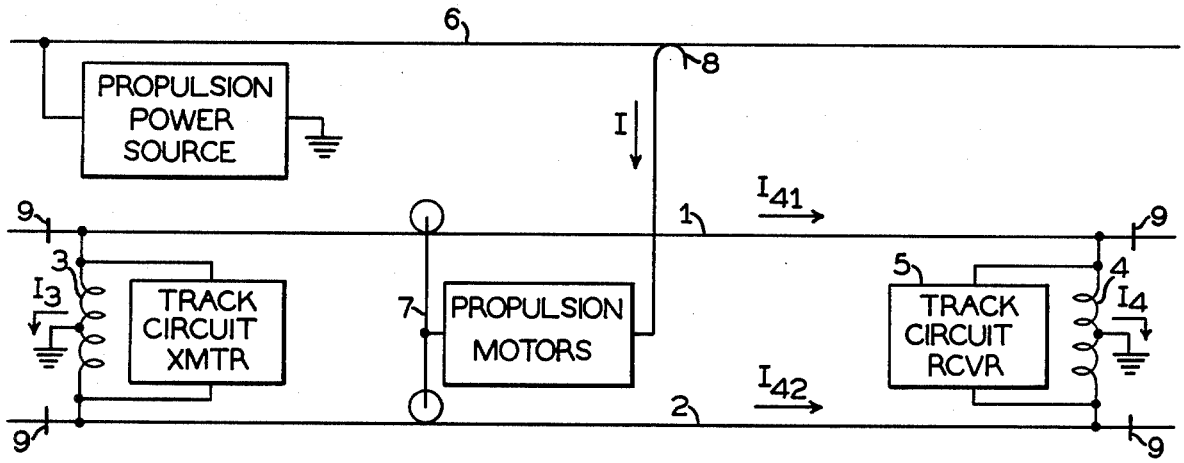
FIG. 1 is a schematic illustration of a track section in an electrified railroad with a conventional track circuit to detect trains and control the signal system controlling train movements.

Referring to FIG. 1, lines 1 and 2 represent the two rails of a track section of a DC electrified railroad, although the arrangement could be adapted to AC propulsion. This section is set off from adjacent sections by insulated rail joints 9. The track section is provided with a track circuit which detects the presence or absence of a train occupying the section and which is used in the signal system governing movement of such trains in any well known manner. It is assumed that this is an alternating current (AC) track circuit having a frequency outside the commercial power source frequency range e.g., an audio or high frequency (AF or HF) type well known in the signaling art, so that the apparatus or elements can be shown by conventional blocks suitably labeled. At the right end of the section, a track circuit receiver 5 is coupled to rails 1 and 2 by an impedance bond 4. This bond is shown having a single winding which is of heavy duty wire providing a low impedance to direct current (DC) propulsion energy but, because of its construction, a high impedance to the AF/HF track circuit current to provide a voltage drop to energize receiver 5. The winding of bond 4 has a center tap which is connected to ground, and/or to the equivalent center tap on the adjacent section bond, to provide a return circuit for propulsion current. The track circuit transmitter is coupled to the rails at the left end of the section by a similar impedance bond winding 3, which also has a center tap connected to ground and/or the adjacent section bond. The track circuit as shown in FIG. 1 operates in the conventional manner. When no train is present between the pairs of insulated joints 9, the receiver element is energized, by energy transmitted through rails 1 and 2 from the transmitter element, to register an unoccupied track section. When a train passes the joints 9 and shunts the rails, the receiver is deenergized and an occupied section is registered. The DC propulsion power is supplied over lead 6, e.g., a catenary (trolley) or a third rail, from the power source block shown at the left. This source is a rectifier arrangement supplied from the commercial AC power system. The rectifier apparatus may be of the mercury arc type or equivalent solid state elements, frequently connected in six phase rectification arrangement. The DC current in lead 6 thus has various ripple components or characteristics at harmonic frequencies of the commercial source. In case of faulty operation of the rectifier elements, such as an open path, the level of one or more of the ripple components may increase considerably. Power is supplied to the driving motors of a train, symbolized by the schematic wheel-axle unit 7, from lead 6 by any known contactor 8, e.g., pantograph or third rail shoe. The propulsion current I thus flows from lead 6 over contactor 8 through the train motors, shown by conventional block, to axle unit 7, thence in both directions in the rails as currents $I_3$ and $I_4$ return to the source through the ground connections at bonds 3 and 4, respectively.

Return current $I_4$ normally divides into substantially equal currents $I_{41}$ and $I_{42}$ in rails 1 and 2, respectively. The flow of these two currents in the halves of winding 4 creates opposing, equal voltage drops which thus have no effect on receiver 5. Under normal conditions, it is the track circuit current flowing between the rails in winding 4 that creates a voltage to energize receiver 5 to register an unoccupied section. The existance of a fault condition in the propulsion circuit paths will unbalance currents $I_{41}$ and $I_{42}$. Such faults include a broken rail length in rail 1 or 2, an accidental low-resistance ground on one rail within the section, or a broken down (failed) insulated joint. Such faults may also be accompanied by an increase in a ripple component in the range of the selected track circuit frequency, e.g., the sixth harmonic of the commercial source frequency. The unbalance in currents $I_{41}$ and $I_{42}$ creates an unbalance in the voltages developed in the halves of winding 4 which supplies a signal, having the various ripple frequencies, to receiver 5. If one of these ripple components, e.g., sixth harmonic, is strong enough and in the general range of the track circuit frequency, receiver 5 receives sufficient energy to register an unoccupied track section whether or not a train is present in the section. Since the propulsion return currents are high when a train is in the section, there is a real danger of unsafe operation of the track circuit under these fault conditions.

Figure 2:
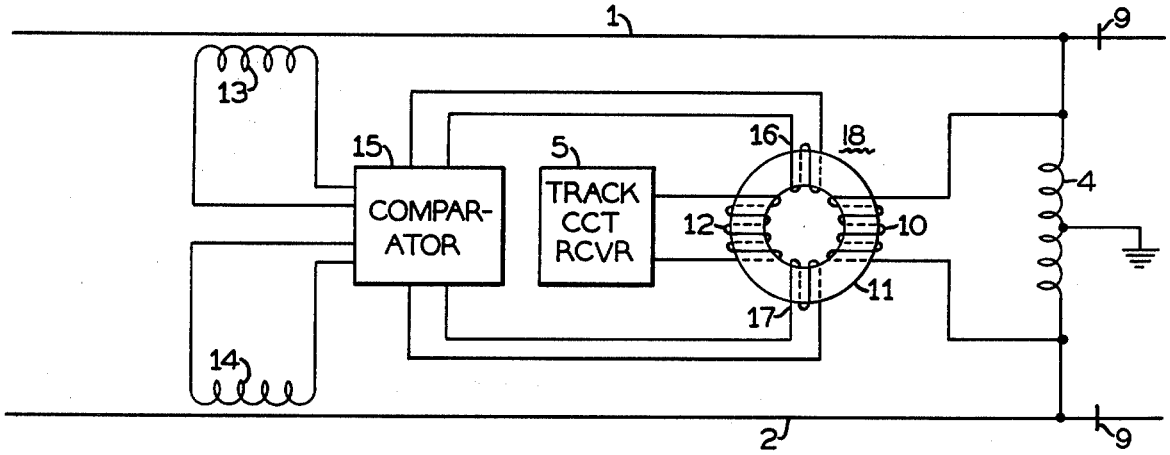
FIG. 2 is a schematic circuit diagram of apparatus at the receiver end of the track circuit of FIG. 1 including specific apparatus embodying my invention.

The schematic circuit diagram in FIG. 2 illustrates, in a conventional manner, a specific arrangement of my invention which protects against a fault condition and prevents it from causing improper or dangerous track circuit operation. Only the track circuit receiver end of the track section is shown with rails 1 and 2, joints 9, bond winding 4 with its center tap to ground, and receiver means 5. Inserted between bond winding 4 and receiver unit 5 is a coupling transformer 18 with an input or primary winding 10 and an output or secondary winding 12 mounted on and thus inductively coupled by a torroidal magnetic core 11. Transformer 18 also has two control windings 16 and 17 although only one control winding may be used in other specific arrangements. Transformer 18 is thus a saturable transformer or magnetic amplifier device which passes signals from bond 4 to receiver 5 only when windings 16 and 17 are deenergized. Said in another way, when windings 16 and/or 17 are energized by DC signals, the core 11 is saturated and coupling between windings 10 and 12 is inhibited and no signals are transferred.

The energy signals for controlling windings 16 and 17 are supplied by a comparator device or network 15 in accordance with the relationship of input signals generated by signal pick up elements 13 and 14. Units 13 and 14 may be any type device which responds to propulsion current flowing in the rails to produce an output signal. They are specifically shown as well as known pick-up or receiver coils, one positioned in inductive relationship with each rail, coil 13 with rail 1 and coil 14 with rail 2. Each coil may be mounted adjacent the side of the associated rail, attached to the bottom thereof or placed in any other convenient position so that the flow of propulsion current, or a particular component, induces a voltage in the coil. This requires also that each coil be tuned to a selected ripple frequency of the DC propulsion current, i.e., the commercial AC frequency or a preselected harmonic of the source supplying the propulsion energy. In at least one installation, it was found desirable to tune the receiver coils to the sixth harmonic of the commercial AC frequency since this ripple frequency is predominate in the rectified DC obtained in the manner previously discussed. In other words, the coils are tuned to a convenient characteristic of the propulsion current which is easily detected to determine whether the levels of current flowing in each rail are balanced.

The signals from coils 13 and 14 are applied to separate inputs of comparator 15, which may be of any well-known type of such device which can compare the similarity or dissimilarity of these inputs. In one form used, device 15 generates an output signal to apply to windings 16 and 17 when the inputs from coils 13 and 14 differ by a preselected amount. The application of this output to windings 16 and 17 saturates transformer 18 and inhibits the transmission of signals from bond 4 to receiver 5. In other words, the saturated condition interrupts the operation of the track circuit to a fail-safe condition registering a train occupancy. In another form of comparator which may be used, a signal is applied to control winding 16 to saturate the transformer when the preselected difference exists between the input signals from coils 13 and 14. Winding 17 is then a depolarization winding to which a signal is applied by comparator 15 as long as the propulsion currents in both rails are substantially equal or balanced, and also if no propulsion current is present to allow continued operation of the track circuit under such condition.

Reviewing briefly the operation of the apparatus, the track circuit receiver 5 (FIG. 2) is energized when no train is occupying the section. Receiver 5 receives energy as a result of the voltage developed in bond winding 4 by track circuit current flowing between rails 1 and 2. This voltage signal is coupled to the receiver by windings 10 and 12 of transformer 18. When a train occupies the section, shunting the rails between the transmitter and receiver (FIG. 1), receiver 5 is deenergized to register the train occupancy. However, proper train detection depends also on the balanced condition of propulsion currents $I_4$, and $I_{42}$ flowing to the ground connection at the center tap of winding 4. If current $I_{41}$ becomes greater than current $I_{42}$ due to a break somewhere in rail 2, the harmonic ripple components create a larger voltage in the upper portion of winding 4 which, coupled through transformer 18, may energize receiver 5 even with a train occupying the track section. However, as described, coils 13 and 14 (FIG. 2) are tuned to respond to a selected ripple component of the propulsion current, e.g., the predominate sixth harmonic of the commercial source, to produce voltage signals for application to comparator 15. Although the track circuit frequency is of the same general range as the ripple to which coils 13 and 14 are tuned, these coils do not produce sufficient output, if any, from the track circuit current to affect comparator 15. If current $I_{41}$ exceeds current $I_{42}$ so that the voltage signals from coils 13 and 14 differ by the preselected amounts, comparator 15 generates an output signal which is applied to windings 16 and 17. This saturates the core 11 of transformer 18 to interrupt the normal coupling of windings 10 and 12 and thus inhibits the coupling. i.e., transmission, of any voltage signals from winding 4 to receiver 5. The receiver thus remains deenergized even though unequal currents flow in the two portions of winding 4. The registration of a false section unoccupied condition while a train is present in the section is prevented regardless of whatever fault condition causes the unbalanced propulsion currents.

The fault protection arrangement of the invention therefore provides an efficient and relatively simple means to inhibit improper operation of a track circuit due to unbalanced propulsion currents flowing in the rails. A broken rail or accidental ground in one rail of a track section will thus be detected by the track circuit and/or fault protection apparatus of the invention and the fail-safeness of the railroad signal system maintained.

Although I have herein shown and described but one specific circuit arrangement embodying the invention, it is to be understood that various changes and modifications within the scope of the appended claims may be made without departing from the spirit and scope of the invention.

Having now described the invention what we claim as new and desire to secure by Letters Patent, is:

1. In combination with a track circuit for an insulated track section in an electrified railroad with a propulsion current return circuit through both track rails and an impedance bond connected across the rails at each end of said section and having a center tap connected to a common return circuit path for normally balancing the propulsion current between the rails, said track circuit including a transmitter source of energy coupled to the rails at one end of said section by the corresponding impedance bond for transmitting energy of a selected frequency and a receiver means coupled to the rails at the other end of said section by the corresponding impedance bond and responsive to energy of said selected frequency for registering the nonoccupancy or occupancy of said section by a train in accordance as energy is received or absent, respectively, a fault protection arrangement comprising, (a) a coupling means connected for coupling said receiver means and the corresponding impedance bond at said other end, (1) said coupling means normally in a first condition to pass energy from said bond to said receiver means and operable to a second condition, when a control signal is applied, for inhibiting the passing of energy to said receiver means, and (b) a comparator means coupled to said rails at said other end and responsive to said propulsion current for generating an output signal when the level of propulsion current in the two rails differs by a predetermined amount, (c) said comparator means connected for applying said output signal to operate said coupling means to its second condition to inhibit the registry of an unoccupied track section when the propulsion current is unbalanced.

2. A fault protection arrangement as defined in claim 1 in which said comparator means includes, (a) a pair of receiver coils, one positioned in inductive relationship with each rail at said other end and tuned to respond only to a preselected characteristic of said propulsion current in the associated rail for producing an output signal, and (b) a comparator circuit network coupled for receiving output signals from said coils and responsive thereto for generating a signal when said output signals indicate a predetermined difference between the levels of said preselected characteristic in said rails, (c) said comparator network connected for applying its generated signal to operate said coupling means to its second condition.

3. A fault protection arrangement as defined in claim 1 in which, (a) said coupling means in a saturable transformer having a primary and a secondary winding for normally coupling said receiver means with the corresponding impedance bond and at least one control winding responsive to an applied signal for saturating the transformer core to inhibit coupling between said primary and secondary windings, and (b) said comparator means is connected for applying said output signal to said control winding of said transformer to interrupt the coupling between said corresponding impedance bond and said receiver means when propulsion current is unbalanced between said rails by said preselected amount.

4. A fault protection arrangement as defined in claim 3 in which, said comparator means is responsive only to a preselected characteristic of said propulsion current for generating said output signal when the levels of said preselected characteristic in said rails differ by said predetermined amount.

5. A fault protection arrangement as defined in claim 4 which further includes, (a) a pair of receiving coils, one coil positioned in inductive relationship with each rail at said other end and tuned for producing a signal in accordance with the level of said preselected characteristic of said propulsion current in the associated rail, and in which, (b) said comparator means is connected for receiving the signal from each coil and is responsive to the coil signals for generating an output signal when the level of the coil signals differs by a preselected amount indicative of a fault induced unbalanced condition of said propulsion currents in the rails, and (c) said comparator means is further connected for applying an output signal to the control winding of said transformer to inhibit operation of said track circuit when the propulsion currents are unbalanced.

6. A fault protected track circuit arrangement for a section of electrified railroad track, for which a rectified propulsion current is supplied by an alternating current source of a commercial frequency, comprising, (a) a transmitter means coupled to the track rails at one end of said section for supplying a selected frequency track circuit current through said rails, (b) a receiver means responsive to the reception of current having said selected frequency for registering an unoccupied section, (c) a coupling means connected for coupling said receiver means to said rails at the other end of said section to normally receive current from said rails, (1) said coupling means having a normal condition for completing the coupling between said receiver means and said rails and operable to an alternate condition, in response to the reception of a control signal, for interrupting the coupling between said receiver means and said rails, and (d) a comparator means coupled to said rails at said other end for comparing the level of said propulsion currents in each rail and responsive to an unbalanced condition of said currents for generating said control signal, (e) said comparator means connected for applying said control signal to said coupling means for inhibiting the registration of an unoccupied section when an unbalanced propulsion current condition is detected.

7. A fault protected track circuit arrangement as defined in claim 6 in which, (a) said coupling means is a saturable transformer having a primary and a secondary winding coupling said receiver means to said rails and at least one control winding which saturates the transformer core when energized to interrupt the normal coupling between said primary and secondary windings, and (b) said comparator means is connected for applying said control signal to energize said transformer control winding.

8. A fault protected track circuit arrangement as defined in claim 7 in which, said comparator means is responsive only to a preselected characteristic of said propulsion current in said rails, resulting from rectification of said commercial frequency alternating current source and of the same order as said selected frequency of the track circuit current.

9. A fault protected track circuit arrangement as defined in claim 8 which further includes, (a) a pair of receiver coils, one positioned in inductive relationship with each rail at said other end and tuned to said preselected characteristic, and in which, (b) said comparator means is coupled to said receiver coils for comparing signals induced therein by said propulsion current preselected characteristic, and (c) said comparator means is responsive for producing a control signal only when said induced signals differ by at least a predetermined amount.

10. A fault protected track circuit arrangement as defined in claim 9 which further includes, (a) a grounded center tap impedance bond connected across the rails at each end of said section for providing normally balanced parallel return circuits for said propulsion current through the track rails, and in which, (b) said transmitter and receiver means are coupled to said rails by the corresponding impedance bond, said transformer being inserted in the coupling between said receiver means and the corresponding impedance bond, and (c) any fault condition in said track section creating an unequal flow of said preselected characteristic of said propulsion current through the impedance bond coupling said receiver means to said rails actuates said transformer for inhibiting an unsafe registration of an unoccupied track section.

* * * * *